US006866563B2

(12) United States Patent
Green

(10) Patent No.: US 6,866,563 B2
(45) Date of Patent: Mar. 15, 2005

(54) APPARATUS AND METHOD FOR TARGET POLISHING INTRAOCULAR LENSES

(75) Inventor: George F. Green, Victor, NY (US)

(73) Assignee: Bausch & Lomb Incorporated, Rochester, NY (US)

( * ) Notice: Subject to any disclaimer, the term of this patent is extended or adjusted under 35 U.S.C. 154(b) by 178 days.

(21) Appl. No.: 10/184,167

(22) Filed: Jun. 27, 2002

(65) Prior Publication Data

US 2004/0002293 A1 Jan. 1, 2004

(51) Int. Cl.[7] ..... B24B 1/00

(52) U.S. Cl. ..... 451/41; 451/41; 451/442; 451/365

(58) Field of Search ..... 451/41–42, 28–29, 451/442, 384, 32–35, 364, 390; 623/6

(56) References Cited

U.S. PATENT DOCUMENTS

| | | | | |
|---|---|---|---|---|
| 2,684,562 A | | 7/1954 | Castle | 51/281 |
| 4,856,234 A | | 8/1989 | Goins | 51/284 R |
| 5,769,889 A | * | 6/1998 | Kelman | 623/6.43 |
| 6,648,741 B2 | * | 11/2003 | Schneider | 451/390 |
| 6,729,939 B2 | * | 5/2004 | Wrue | 451/29 |
| 2003/0114093 A1 | * | 6/2003 | Wrue | 451/442 |
| 2003/0176918 A1 | * | 9/2003 | Schneider | 623/6.11 |

FOREIGN PATENT DOCUMENTS

| | | | |
|---|---|---|---|
| DE | 3303745 A1 | 8/1984 | B24B/31/06 |
| JP | 58090458 A | 8/1983 | B24B/31/00 |
| WO | 02/16077 A | 2/2002 | B24B/31/10 |

OTHER PUBLICATIONS

U.S. Appl. No. 10/022,101, Entitled "Polishing Mask for Intraocular Lens", filed Dec. 17, 2001, by R. Wrue.

U.S. Appl. No. 10/184,552, Entitled "Method for Polishing Intraocular Lenses", filed Jun. 27, 2002, by G. Green.

* cited by examiner

*Primary Examiner*—Lee D. Wilson
(74) *Attorney, Agent, or Firm*—Craig E. Larson

(57) ABSTRACT

A mask for removably covering an IOL to protect a sharp peripheral edge of the IOL optic during polishing.

4 Claims, 5 Drawing Sheets

FIG. 1
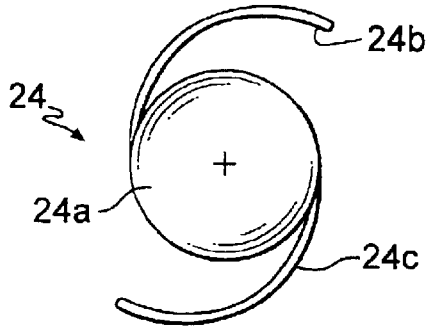
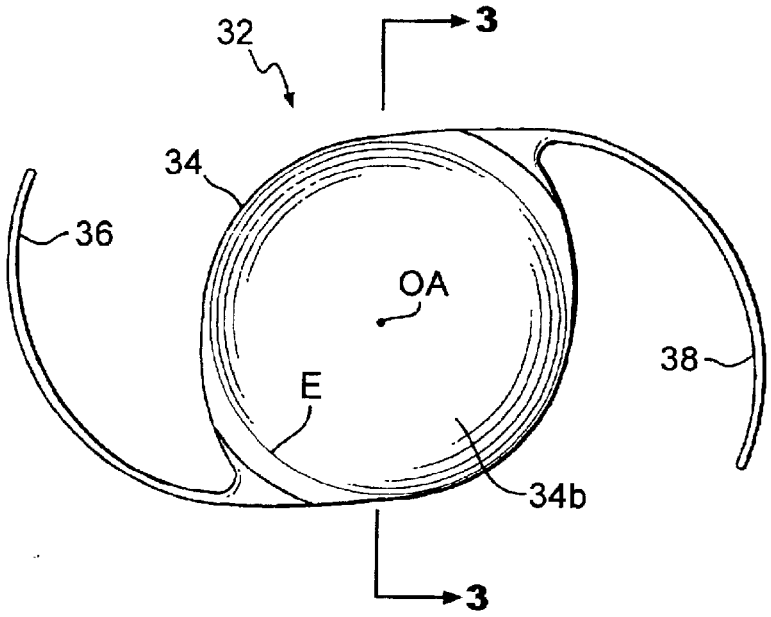
FIG. 2
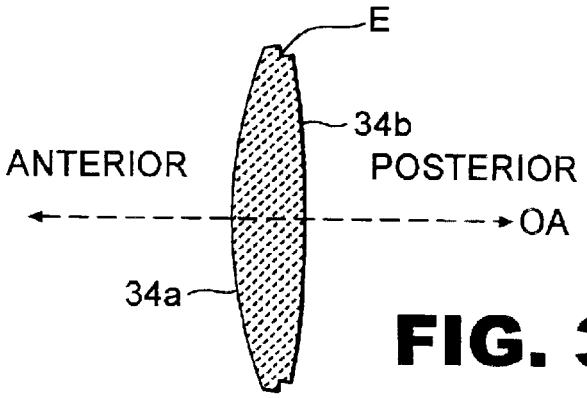
FIG. 3

APPARATUS AND METHOD FOR TARGET POLISHING INTRAOCULAR LENSES

BACKGROUND OF THE INVENTION

The present invention relates to the manufacture of intraocular lenses (IOLs) for implantation in an eye. The present invention more particularly relates to a protective IOL mask in which an IOL may be removably inserted prior to a polishing operation. The IOL mask is particularly adapted for arrangement in an array which allows for batch polishing of the IOLs and wherein only selected areas of the IOLs are polished.

IOLs require highly polished surfaces free of surface irregularities. This is because the IOL is in direct contact with delicate eye tissues and any rough or non-smooth surface on an IOL may cause irritation or abrading of tissue or other similar trauma to the eye. It has been found that even small irregularities can cause irritation to delicate eye tissues.

IOLs are typically either molded, milled, or lathe cut. Subsequent to any of these operations, the IOLs usually have irregular or roughened surfaces that need to be smoothed. It is thus usually necessary to polish the IOL to smooth out any rough areas on the IOL. One known polishing method is tumble polishing wherein a batch of IOLs are placed in a tumbler for several hours with a polishing agent. Examples of IOL tumble polishing apparatus and methods may be seen in the following patents:

U.S. Pat. No. 5,133,159 discloses a method of tumble polishing silicone articles in a receptacle charged with a mixture of non-abrasive polishing beads and a solvent which is agitated to remove surface irregularities from the articles.

U.S. Pat. No. 5,571,558 discloses a tumbling process for removing flash from a molded IOL by applying a layer of aluminum oxide on a plurality of beads, placing the coated beads, alcohol, water and silicone IOLs in a container and tumbling the same to remove flash.

U.S. Pat. No. 5,725,811 discloses a process for removing flash from molded IOLs including tumbling the IOLs in a tumbling media of 0.5 mm diameter glass beads and 1.0 mm diameter glass beads, alcohol and water.

In the prior at methods, the entire IOL is polished, including the entire optic and haptics. However, there are certain IOL designs where it is not desirable to polish the entire IOL. For example, in recent years, IOLs have been designed with sharp posterior edges which has been found to inhibit the unwanted growth of lens epithelial cells (LECs) between the IOL and posterior capsular bag, also known as posterior capsule opacification or "PCO" to those skilled in the art. One such method for creating a sharp posterior edge in an IOL is described in copending application Ser. No. 10/005,864 filed on Nov. 8, 2001 and of common ownership with the present application, the entire disclosure of which is incorporated herein by reference. Creating a sharp, discontinuous bend in the posterior capsule wall is widely recognized by those skilled in the art as an effective method for minimizing PCO. See, for example, *Posterior Capsule Opacification* by Nishi, *Journal of Cataract & Refractive Surgery*, Vol. 25, January 1999. This discontinuous bend in the posterior capsule wall can be created using an IOL having a posterior edge which forms a sharp edge with the peripheral wall of the IOL.

Thus, while polishing is a necessary step in the IOL manufacturing process to remove surface irregularities, a purposely formed, sharp, posterior edge is one area of the IOL which should not be polished. If this area of the IOL is not protected from the polishing operation, the sharp posterior edge will become rounded and not function to inhibit PCO as intended. There thus remains a need for a method for polishing IOLs having sharp posterior edges wherein selected areas of the IOL, particularly the sharp posterior edge, is protected from the rounding effect of the polishing operation.

SUMMARY OF THE INVENTION

The present invention addresses the problem of protecting predetermined areas of an IOL during the polishing operation by providing a mask for attaching to a respective IOL prior to subjecting the IOL to polishing. The mask is configured to cover selected areas of the IOL. In one embodiment, only the sharp peripheral edge of the IOL is covered by the IOL mask such that only this selected area of the IOL is not polished during the polishing operation, leaving the haptics and central optic portions exposed to the polishing operation. In another embodiment, the optic anterior and/or posterior surfaces and optic peripheral edge are covered by the IOL mask such that these areas of the IOL are not polished while only the haptics are polished. In a preferred embodiment, a plurality of masks are provided in an array which allows for semi or fully automated batch processing of a respective plurality of IOLs at a time.

BRIEF DESCRIPTION OF THE DRAWING

FIG. 1 is a plan view of a prior art IOL design;

FIG. 2 is a plan view of an IOL having a sharp posterior edge design;

FIG. 3 is a cross-sectional view of the IOL as taken generally along the line 3—3 of FIG. 2;

DETAILED DESCRIPTION

Figure 4A:
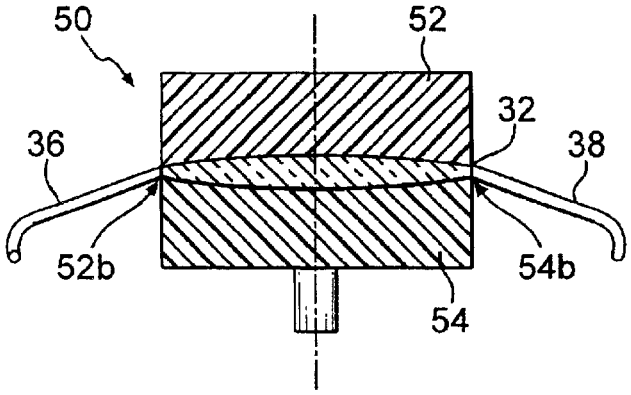
FIG. 4 is a plan view of an IOL having a sharp posterior edge inserted into a first embodiment of the mask of the present invention.

As stated in the Background section hereof, a well known surgical technique to correct cataracts involves removal of the cataractous crystalline lens of the eye which may be replaced with an artificial lens known as an intraocular lens or IOL such as prior art IOL 24 seen in FIG. 1. PCO is an undesirable post-surgical condition of intraocular lens implant surgery which occurs when an implanted IOL becomes clouded and is no longer able to properly direct and focus light therethrough. The main cause for this condition is the mitosis and migration of lens epithelial cells (LECs) across the posterior surface of the lens capsule behind the IOL optic.

Although there are many different IOL designs as well as many different options as to exact placement of an IOL within an eye, the present invention concerns itself with an IOL having portions thereof which require non-rounded geometries and/or surfaces. A particular example of such an IOL is an IOL having a sharp posterior edge for implanting inside the capsule of an eye (not shown) wherein the sharp posterior edge is designed to inhibit PCO. This implantation technique is commonly referred to in the art as the "in-the-bag" technique. In this surgical technique, a part of the anterior portion of the capsular bag is cut away (termed a "capsularhexis") while leaving the posterior capsule intact. In the "in-the-bag" technique of IOL surgery, the IOL is placed inside the capsule which is located behind the iris in the posterior chamber of the eye.

As seen in FIG. 1, an IOL includes a central optic portion 24*a* which simulates the extracted natural lens by directing and focusing light upon the retina, and further includes means for securing the optic in proper position within the capsular bag. A common IOL structure for anchoring the IOL in the eye is called a haptic which is a resilient structure extending radially outwardly from the periphery of the optic. In a particularly common IOL design, two haptics 24*b*, 24*c* extend from opposite sides of the optic and curve to provide a biasing force against the inside of the capsule which secures the IOL in the proper position within the capsule.

It is intended that upon implantation of the IOL, the posterior surface of the capsule touches the posterior surface of the IOL optic 24*a*. When the damaged natural lens is surgically removed, a number of LECs may remain within the capsule, particularly at the equator thereof which is the principle source of germinal LECs. Although a surgeon may attempt to remove all LECs from the capsular bag at the time of IOL implantation surgery, it is nearly impossible to remove every single LEC. Any remaining LECs can multiply and migrate along the posterior capsule wall. This is especially true in IOLs having rounded edges, where it has been found that clinically significant PCO results in about 20%–50% of patients three years post surgery. A presently popular and effective method of preventing PCO is to create a sharp, discontinuous bend in the posterior capsule wall as explained in the Background section hereof.

Referring now to FIGS. 2 and 3, an IOL 32 is shown which includes a central optic portion 34 having opposite anterior and posterior surfaces 34*a* and 34*b*, respectively. When implanted within the eye, anterior optic surface 34*a* faces the cornea and posterior optic surface 34*b* faces the retina. A pair of haptics 36,38 attach to and extend from opposite sides of the periphery of optic portion 34 and are configured to provide a biasing force against the interior of the capsule to properly position IOL 32 therein. More particularly, the haptics 36,38 are configured such that upon implanting the IOL with the capsular bag, the haptics engage the interior surface of the capsular bag. The engagement between the haptics and capsule creates a biasing force causing the IOL optic 34 to vault posteriorly toward the retina whereupon the posterior surface 34*b* of the IOL optic presses tightly against the interior of the posterior capsule wall of the capsule. It is noted that other known IOL positioning means are possible and within the scope of the invention. Furthermore, IOL 32 may be made from any suitable IOL material, e.g., PMMA, silicone, hydrogels and variations thereof The IOL 32 may also be a one piece or multiple piece design (e.g. where the haptics are attached to the optic after the optic is formed.)

Referring still to FIGS. 2 and 3, it is seen that IOL optic 34 has a periphery including a sharp edge E defined at the juncture of posterior surface 34*b* and peripheral wall P. With the haptics 36,38 providing the biasing force explained above, the optic posterior surface 34*b* presses tightly against the posterior capsule wall. Since the lens capsule is somewhat resilient in nature, the force of the IOL optic against the capsule wall results in the IOL indenting into the posterior capsule wall. The sharp edge E of the IOL optic thus forcibly indents into the capsule wall and thereby creates a discontinuous bend in the posterior capsule wall at this point. As explained above, this discontinuous bend in the posterior capsule wall acts to inhibit LEC migration past this point (i.e., between the posterior capsule wall and IOL posterior surface 34*b*) and PCO is substantially inhibited.

Figure 4B:
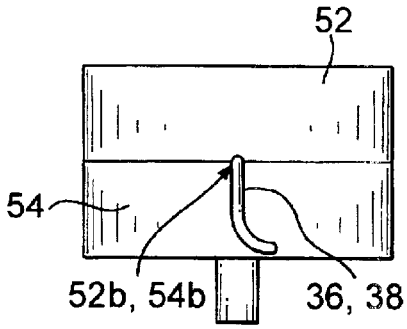
Figure 6:
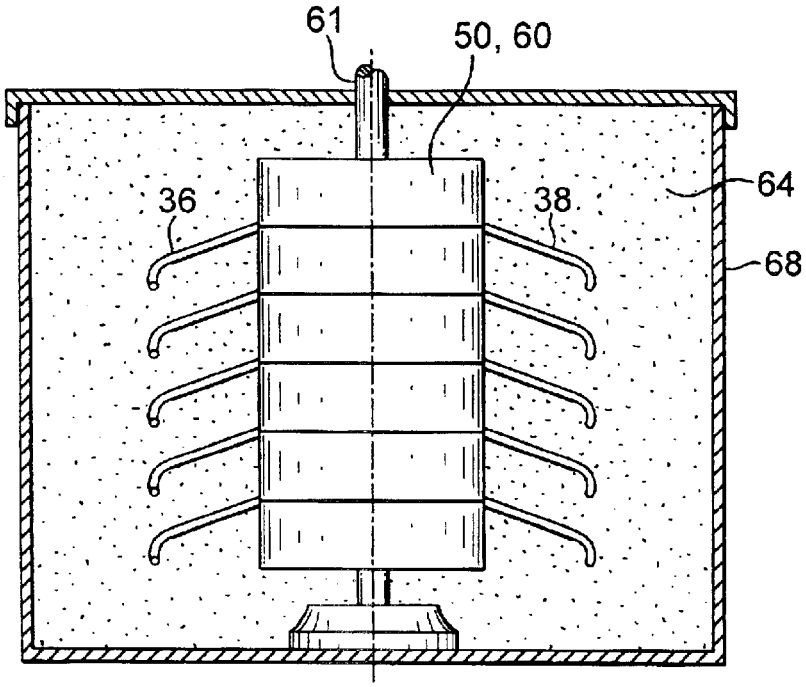
FIG. 6 is a side elevational view of the array of FIG. 5 showing the array in the fully stacked position and contained with the polishing slurry and readied for the polishing operation.
Figure 5:
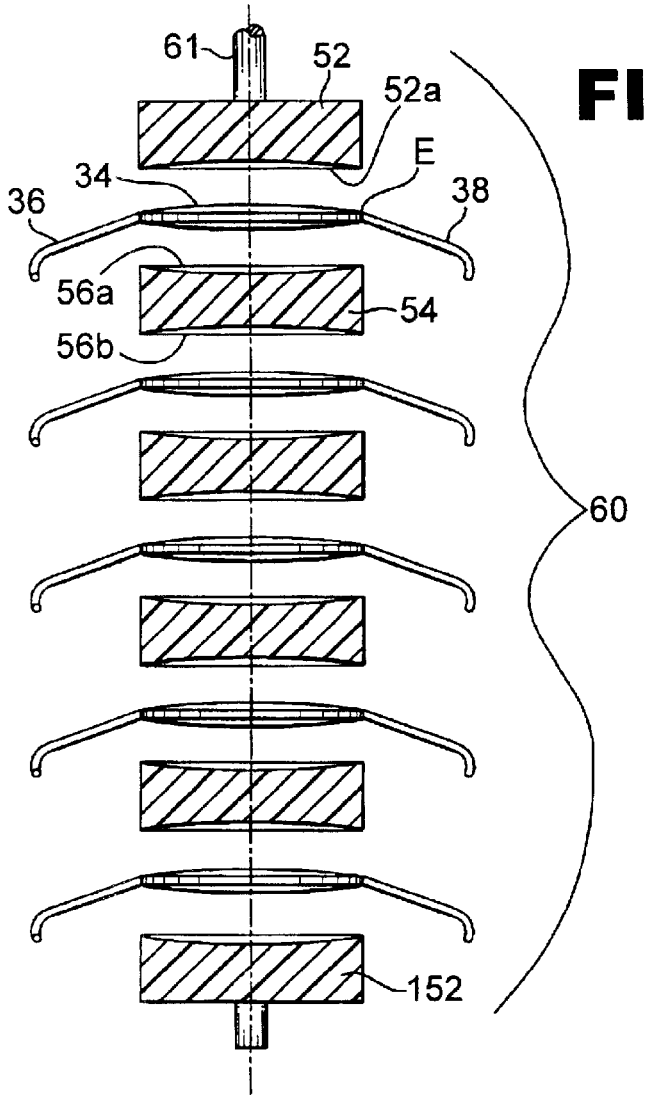
FIG. 5 is an exploded view of a stacked array of a plurality of the IOL masks of FIG. 4.

Referring now to FIGS. 4–6, discussion is turned to a first embodiment of the inventive mask designated generally by reference numeral 50 in which IOL 32 may be inserted to cover and protect the sharp posterior edge E thereof during the polishing of IOL 32. Once polishing is completed, IOL 32 is removed from mask 50 to reveal the still sharp posterior edge E thereof The IOL 32 may then processed further as desired (e.g., hydration, sterilization and packaging).

Mask 50 is preferably made of a material which is sufficiently stable to permit multiple reuse thereof Some examples of possible materials include, but are not limited to, metals, plastics, ceramics and composites. Mask 50 includes first and second halves 52,54, respectively, having facing surfaces 52*a*, 54*a* shaped to generally conform to the corresponding shapes of posterior surface 34*b* and anterior surface 34*a* of optic 34. As such, when IOL 32 is inserted between the first and second halves of mask 50, the entire optic peripheral wall P including sharp edge E is covered by mask 50. This is best seen in FIGS. 4, 6 and 8.

To insert IOL 32 within mask 50, the first and second halves 52,54 thereof are spaced apart from each other whereby IOL 32 may be positioned therebetween. Apertures 52*a*,54*b* are formed when the mask 50 is closed about IOL 32 so as to permit the haptics 36,38 to extend therethrough and extend outwardly of mask 50. Once attached to a respective IOL in this manner, the sharp peripheral edge E of IOL 34 is protected by mask 10 while the haptics 36,38 of the IOL are left exposed. As such, the polishing of IOL will affect only the exposed areas of the IOL, leaving the sharp peripheral edge E of the IOL unpolished and sharp, as intended. Once polishing is complete, mask 50 is opened whereupon clearance is provided to remove the IOL 32 therefrom while withdrawing haptics 36,38 back through apertures 52*a*,54*a*, respectively. Although not shown, any type of releasable closure means may be employed to alternately open and close mask 50 about the IOL (e.g., a clamp or cooperative press-fit between the mask halves).

FIGS. 5 and 6 show a plurality of masks 50 arranged in a stacked array 60 with the bottom half 54' of the uppermost mask 50 also serving as the top half of the next mask in the array. Thus, each mask half in the array located between the upper-most mask half 52 and bottom-most mask half 152 serves to cover two IOL optics at a time. In this instance, both the top and bottom surfaces 56*a*, 56*b* of the mask half are configured to cover the corresponding IOL optic surface.

The stacked array 60 may be mounted to a rotatable spindle 61 and placed in a tank 62 containing a polishing slurry 64 as seen in FIG. 6. With the mask halves assembled together about their respective IOLs, the spindle is rotated within the polishing slurry until the haptics 36,38 are polished. The mask halves are then separated and the IOLs are retrieved therefrom for further processing as required. The movement of the mask halves between the separated position seen in FIG. 5 and the closed position seen in FIG. 6 may be performed in an automated manner using electromechanical controls known on the art. Insertion and removal of the IOLs from between the mask halves may also be subject to automated workpiece handling in this regard (e.g., using a robotic vacuum pick-and-place head).

Figure 7:
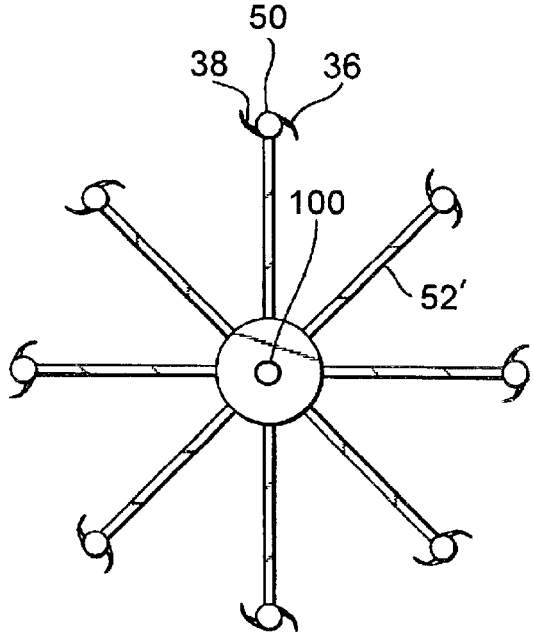
FIG. 7 is a top plan view of a second embodiment of the invention showing a radial array of IOL masks.
Figure 8A:
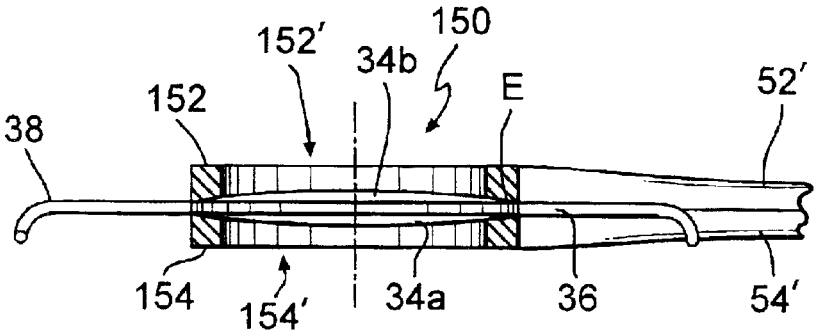
FIG. 8 is a side elevational, cross-sectional view through one of the masks of FIG. 7.
Figure 8B:
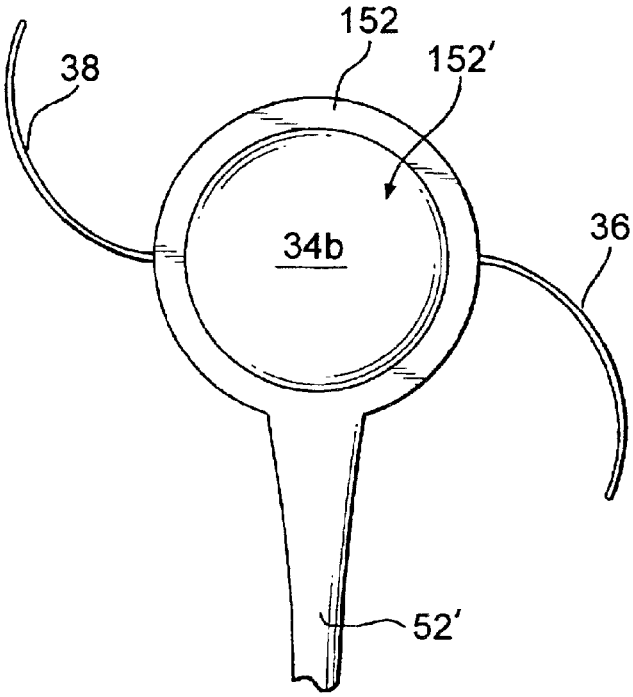
Figure 9:
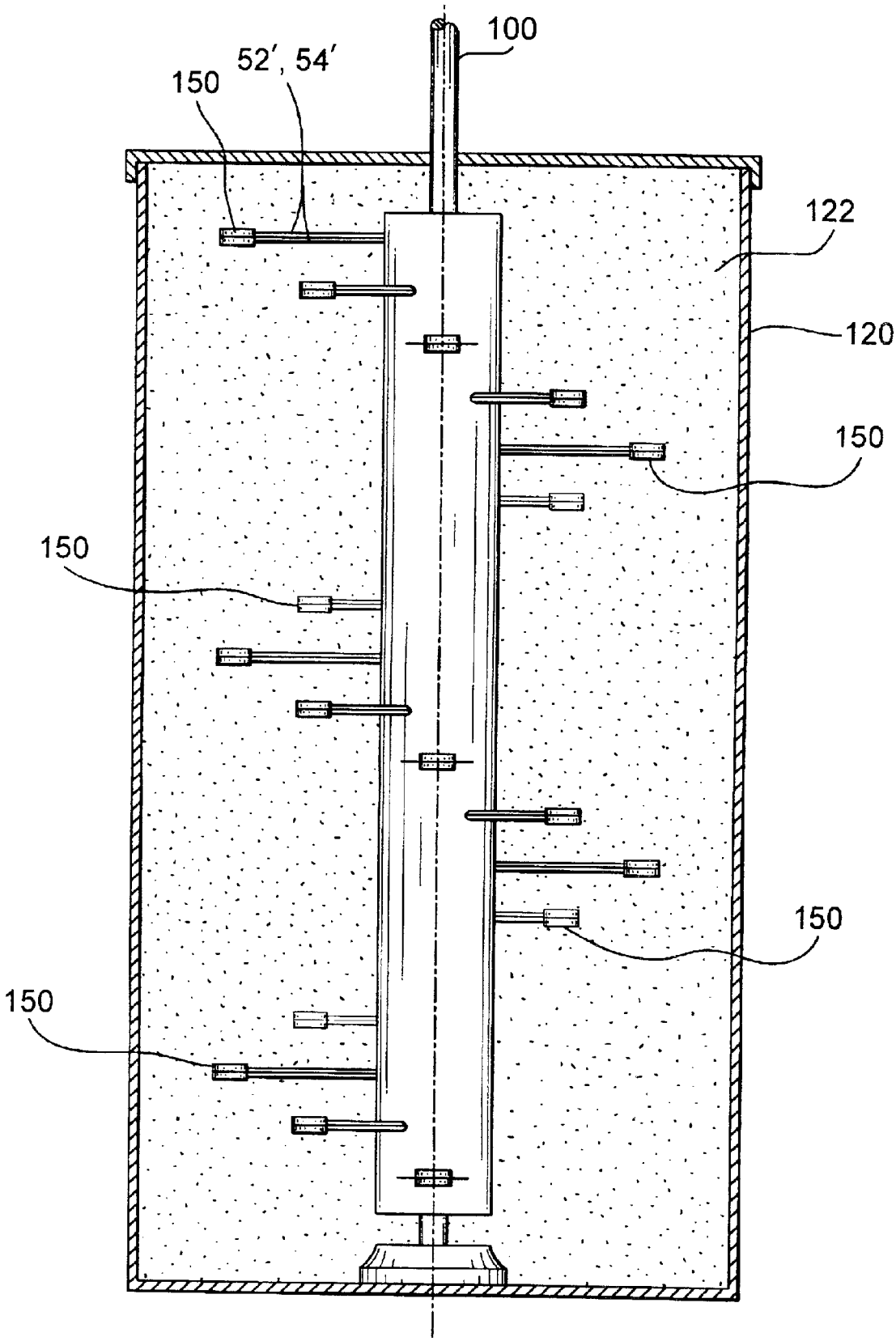
FIG. 9 is a side elevational view of the array of FIG. 7 showing the array contained within a tank of polishing slurry and readied for the polishing operation.

A second embodiment of the invention is seen in FIGS. 7–9 wherein a plurality of masks 50 are placed in a radially spaced array about a central rotatable spindle 100. In this embodiment, each mask half 52 and 54 is attached to one end of an elongated arm 52' and 54', respectively, with the other end of the arms 52', 54' attached to spindle 100. Means are provided to allow arms 52' and 54' to move alternately toward and away from each other which causes mask halves 52 and 54 to also move toward and away from each other. As such, the mask halves may be separated to provide the necessary clearance for insertion and removal of a respective IOL from mask halves 52 and 54 between polishing cycles. As stated above with regard to FIGS. 4–6, this may be accomplished using automated handling controls.

As described above, mask 50 may be configured to cover the entire IOL optic (as seen in FIGS. 4–6), or just the peripheral sharp edge E thereof (as seen in FIGS. 8*a* and 8*b*). Thus, mask 150 is shown in FIGS. 8*a* and 8*b* including mask halves 152, 154 formed in the shape of rings having open centers 152' and 154' whereby the optic anterior and posterior surfaces34*a*, 34*b* are exposed and polished (along with haptics 36, 38) during the polishing operation. Since mask 150 still covers the sharp peripheral edge E thereof, this area is not polished and hence remains sharp as intended. It is therefore understood that a plurality of masks 50 and masks 150 may be used in any array, including the arrays of FIGS. 4–6 and FIGS. 7–9.

FIG. 9 shows a plurality of masks 150 arranged in the radial array of FIG. 7 attached to spindle 100 via respective arms 52', 54' in a spiral pattern. The array and spindle are placed into a tank 120 containing polishing slurry 122 and spindle 100 is rotated therein. Once the polishing cycle is complete, the masks 150 are opened and the respective IOLs are removed therefrom for further processing as required.

While the invention has been described with regard to preferred embodiments thereof, it is understood that variations may be made thereto without departing from the full spirit and scope of the invention which is defined in the following claims.

What is claimed is:

1. A method for polishing selected areas of an IOL while leaving the remaining areas of the IOL unpolished, said IOL having an optic and at least one haptic, said method comprising the steps of:

a) providing a plurality of masks each having first and second halves configured to removably cover said remaining areas of a respective plurality of said IOL during said polishing;

b) removably locating said IOLs in a respective said mask between said first and second halves thereof;

c) placing said IOLs and said respective mask in an array and placing said array in a tank of polishing slurry;

d) polishing said IOLs;

e) removing said IOLs from said respective mask, wherein said remaining areas of each of said IOLs are not polished.

2. The method of claim 1 wherein said array is a vertically stacked array.

3. The method of claim 1 wherein said array is a radially spaced array.

4. The method of claim 1 wherein said array is attached to a rotatable spindle which is set rotating during said polishing.

* * * * *